US008333180B2

(12) United States Patent
Mizek

(10) Patent No.: US 8,333,180 B2
(45) Date of Patent: Dec. 18, 2012

(54) MOVEABLE ARROW REST

(75) Inventor: Robert S. Mizek, Downers Grove, IL (US)

(73) Assignee: New Archery Products Corp., Forest Park, IL (US)

( * ) Notice: Subject to any disclaimer, the term of this patent is extended or adjusted under 35 U.S.C. 154(b) by 202 days.

(21) Appl. No.: 12/721,324

(22) Filed: Mar. 10, 2010

(65) Prior Publication Data

US 2011/0168148 A1 Jul. 14, 2011

Related U.S. Application Data

(60) Provisional application No. 61/335,806, filed on Jan. 12, 2010.

(51) Int. Cl.
*F41B 5/22* (2006.01)

(52) U.S. Cl. ..... 124/44.5

(58) Field of Classification Search ..... 124/44.5
See application file for complete search history.

(56) References Cited

U.S. PATENT DOCUMENTS

| | | | | |
|---|---|---|---|---|
| 3,769,956 | A | 11/1973 | Simo | |
| 4,074,674 | A | 2/1978 | Simo | |
| 4,244,345 | A | 1/1981 | Simo et al. | |
| 4,530,342 | A | 7/1985 | Simo | |
| 4,803,971 | A * | 2/1989 | Fletcher | 124/44.5 |
| 4,898,145 | A | 2/1990 | Simo | |
| 5,063,678 | A | 11/1991 | Simo | |
| 5,103,797 | A * | 4/1992 | Newbold | 124/44.5 |
| 5,245,980 | A * | 9/1993 | Colvin | 124/24.1 |
| 5,522,375 | A | 6/1996 | Simo et al. | |
| 5,722,381 | A | 3/1998 | Mizek | |
| 5,743,245 | A | 4/1998 | Mizek | |
| 6,050,251 | A | 4/2000 | Harwath et al. | |
| 6,089,216 | A | 7/2000 | Harwath et al. | |
| 6,102,020 | A | 8/2000 | Mizek et al. | |
| 6,178,959 | B1 * | 1/2001 | Troncoso et al. | 124/44.5 |
| 6,634,349 | B2 | 10/2003 | Mizek et al. | |
| 6,782,881 | B2 | 8/2004 | Mizek et al. | |
| 6,913,008 | B2 | 7/2005 | Simo et al. | |
| 6,915,791 | B2 | 7/2005 | Harwath et al. | |
| 7,047,959 | B2 | 5/2006 | Simo et al. | |
| 7,331,338 | B2 | 2/2008 | Mizek | |
| 7,337,773 | B2 | 3/2008 | Simo et al. | |
| 7,856,968 | B2 | 12/2010 | Mizek et al. | |
| 2008/0236556 | A1 * | 10/2008 | Sims et al. | 124/24.1 |
| 2010/0006079 | A1 | 1/2010 | Harwath et al. | |
| 2010/0263651 | A1 * | 10/2010 | Evans | 124/44.5 |

OTHER PUBLICATIONS

Co-Pending U.S. Appl. No. 12/653,287; Filing Date: Dec. 11, 2009; inventors Miroslav A. Simo et al.; title Archery Bow Riser.

* cited by examiner

*Primary Examiner* — John Ricci
(74) *Attorney, Agent, or Firm* — Pauley Petersen & Erickson

(57) ABSTRACT

An arrow rest for supporting an arrow shaft with respect to an archery bow. A support element is moveably mounted between a first position or a load position and a second position or a launch position. In the launch position, the arrow shaft can be forced into, such as by the forces of gravity, a centered location or a preferred shooting position.

22 Claims, 8 Drawing Sheets

MOVEABLE ARROW REST

CROSS REFERENCE TO RELATED APPLICATION

This application claims the benefit of U.S. Provisional Application No. 61/335,806, filed 12 Jan. 2010, the disclosure of which earlier application is incorporated by reference herein and made a part hereof, including but not limited to those portions which specifically appear in this application.

BACKGROUND OF THE INVENTION

1. Field of the Invention

This invention relates to an apparatus for moving an arrow rest between a first position or a loaded position and a second position or a launch position, using a support surface that moves or forces an arrow shaft towards or into a shooting position.

2. Discussion of Related Art

Many conventional moveable arrow rests move between one position in which an arrow shaft is supported by an arrow support and another position in which the arrow shaft is supported and ready for launch. In many moveable arrow rests, it is important for the support portion of the arrow rest to move out of the way of a discharged arrow, particularly so that the fletching will clear all components of the moveable arrow rest.

Many conventional arrow rests have mechanical adjustments for selecting and setting different shooting positions of the arrow shaft with respect to the archery bow. Many of the conventional adjusting devices allow for adjustable movement in two different linear directions. Many of the adjustable devices can be locked into a final position to fix the shooting position with respect to the archery bow.

There is an apparent need for a moveable arrow rest that can be quickly adjusted into one of many different shooting positions, and also that can be automatically moved into the shooting position as the arrow support moves from the first position to the second position.

SUMMARY OF THE INVENTION

The arrow rest of this invention can be used to support an arrow shaft in at least two different positions, such as a load position and a launch position. When moved into the launch position, a support element according to this invention can be used to move an arrow shaft into a centered location or a shooting position, with respect to the arrow rest and/or an archery bow.

A non-planar support surface of a support element can be moved between the load position and the launch position. The support element can be rotatably or pivotably mounted and/or the support element can be constructed of a flexible material which allows the arrow rest to move between the load position and the launch position.

Depending upon a desired location for the shooting position or a shooting window, locking devices according to this invention can be used to move the support element of the arrow rest in at least one linear direction, preferably two or three linear directions that are generally perpendicular with respect to each other.

Quick-release levers can be used according to this invention, to provide more convenient field adjustments for an adjustable lock device.

BRIEF DESCRIPTION OF THE DRAWINGS

The above and other features and objects of this invention will be better understood from the following detailed description taken in view of the drawings, wherein.

DESCRIPTION OF PREFERRED EMBODIMENTS

Many structures or apparatuses and the methods or processes for producing structures or apparatuses are know to those skilled in the art of manufacturing arrow rests, particularly moveable or move-away arrow rests. U.S. Pat. No. 6,634,349, U.S. Pat. No. 6,915,791 and U.S. Pat. No. 7,331,338 each teaches known technologies associated with structures and methods for producing moveable and/or move-away arrow rests, and the entire teachings of each is incorporated into this specification by reference to U.S. Pat. No. 6,634,349, U.S. Pat. No. 6,915,791 and U.S. Pat. No. 7,331,338. Some of the features of this invention are similar to corresponding features taught by these U.S. patents, and features taught by these U.S. patents are intended to be interchanged with and/or made a part of this specification.

Figure 1:
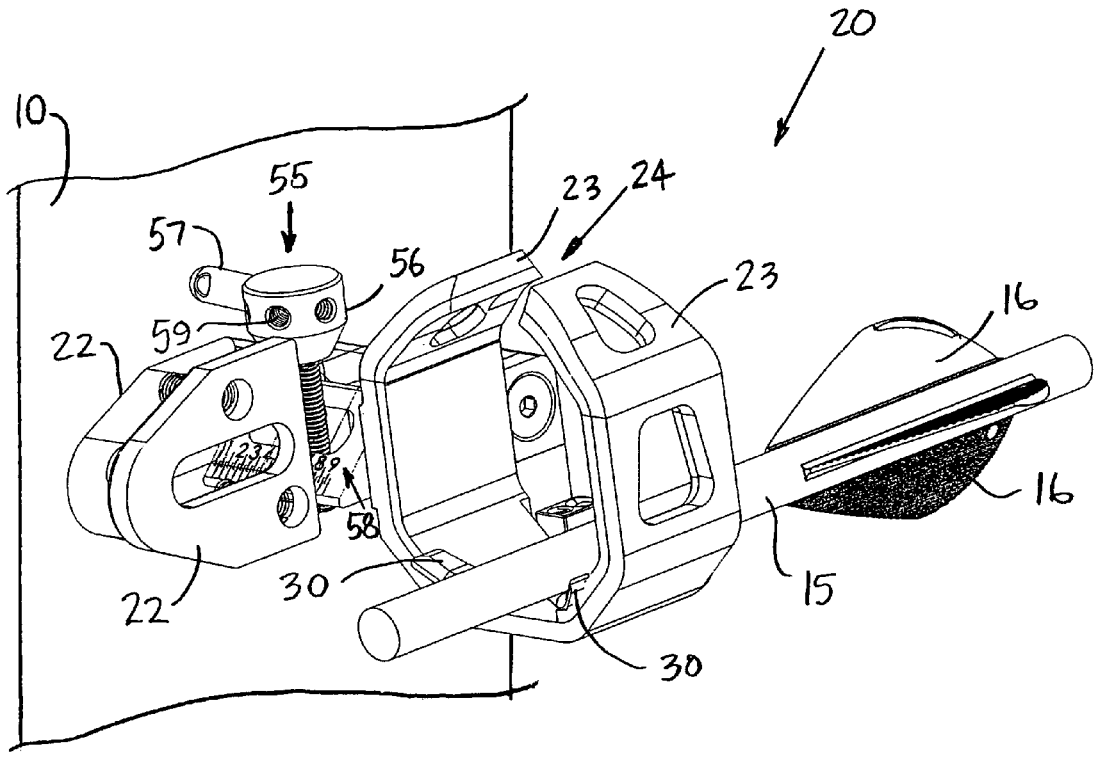
FIG. 1 is a top right perspective view of a moveable arrow rest showing the arrow in a load position, according to one embodiment of this invention.

FIGS. 1-4 show different views of arrow rest 20, according to one embodiment of this invention. As shown in FIG. 1, for illustration purposes, support 22 is attached or otherwise secured directly to or indirectly with respect to archery bow 10. Any suitable conventional attachment can be used to fix the position of support 22 with respect to archery bow 10. FIGS. 1-4 show support 22 as a bracket with threaded bores that accept an externally threaded stud that also fits within a conventional or standard bore within archery bow 10. Any other suitable connection can be used to fix support 22 with respect to archery bow 10. As shown in FIGS. 1-4, frame 23 has an overall cage structure or arrangement. Any other suitable frame structure or component can be used to mechanically connect, such as in a moveable manner, support element 30 with respect to support 22 and/or archery bow 10.

Figure 2:
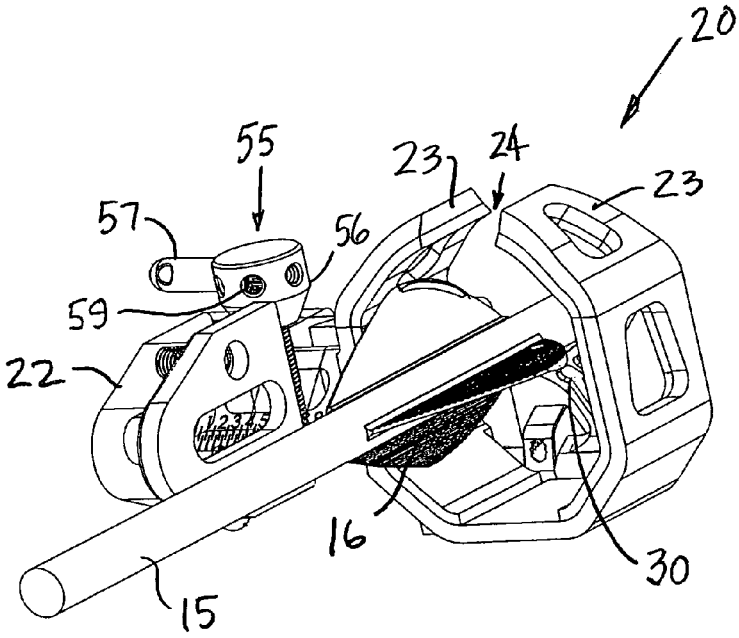
FIG. 2 is a top right perspective view of the moveable arrow rest as shown in FIG. 1, but in a launch position.

FIGS. 1 and 2 each shows a top right perspective view of arrow shaft 15 mounted with respect to arrow rest 20, according to one embodiment of this invention. FIG. 1 shows arrow shaft 15 and thus arrow rest 20 in a load position or a first position. In some embodiments according to this invention, arrow rest 20 moves from the load position to a launch position or a second position, such as shown in FIG. 2. In some embodiments according to this invention, the load position shown in FIG. 1 occurs while loading arrow shaft 15 within arrow rest 20 and/or archery bow 10. Normally, before or during movement of a bowstring of archery bow 10 from a non-drawn position to a drawn position, arrow shaft 15 and thus support element 30 of arrow rest 20 move into the launch position as shown in FIG. 2.

In some embodiments according to this invention, as the bowstring is released, support element 30 moves away from or drops away from arrow shaft 15, particularly so that fletching 16 adequately clears all elements of arrow rest 20.

As shown in FIGS. 1-4, frame 23 forms opening 24, according to one embodiment of this invention. Opening 24 provides clearance for arrow shaft 15 and/or fletching 16. Any other suitable structure or mechanical arrangement can be used to accomplish a similar result of providing clearance for arrow shaft 15 and particularly fletching 16.

Figure 3:
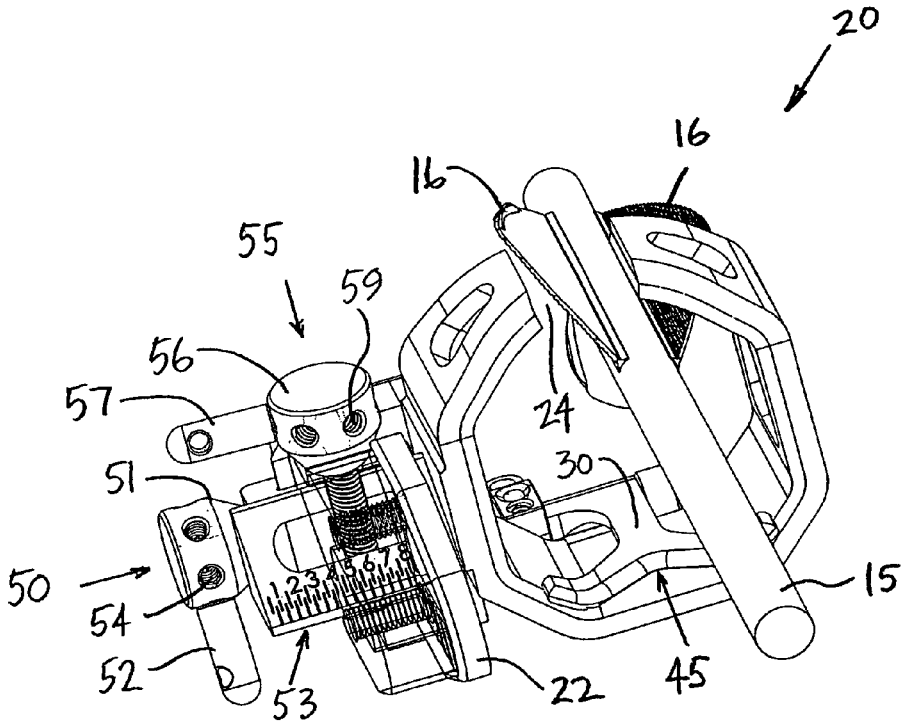
FIG. 3 is a top left perspective view of the moveable arrow rest, as shown in FIG. 1.
Figure 4:
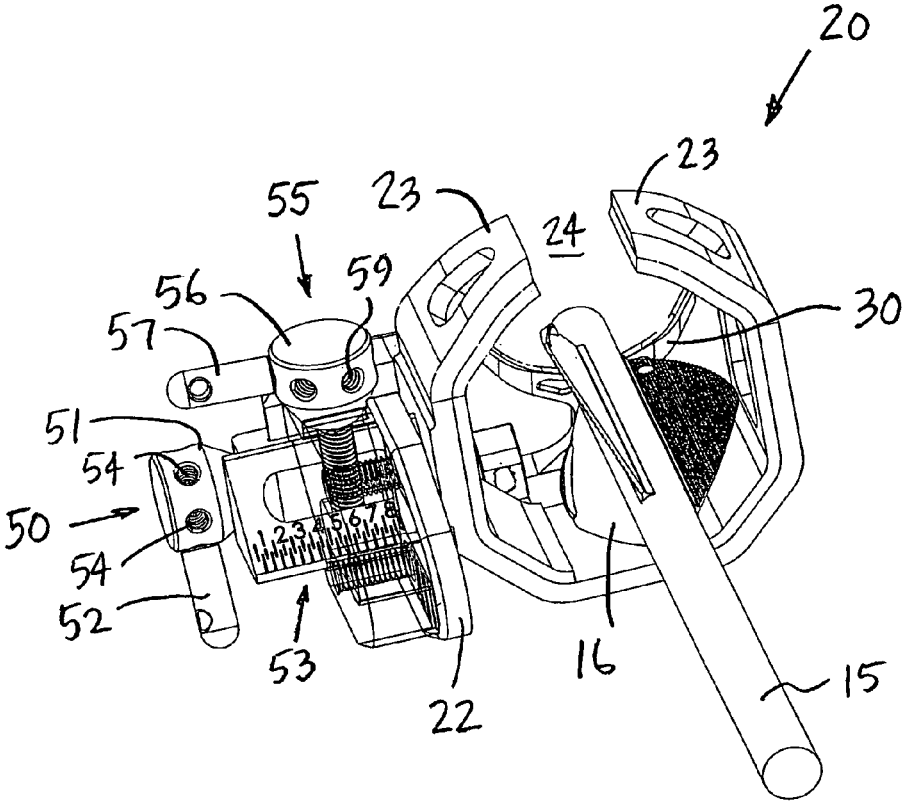
FIG. 4 is a top left perspective view of the moveable arrow rest, as shown in FIG. 2.

Each of FIGS. 1 and 3 show support element 30 in a load position or a first position. Each of FIGS. 2 and 4 show similar views as FIGS. 1 and 3, respectively, except that support element 30 and thus arrow shaft 15 are in a launch position or a second position. As used throughout this specification and in the claims, the terms first position and load position are intended to be interchangeable and relate to a starting position, for example, and the terms launch position and second position are intended to be interchangeable with each other and relate to a position in which arrow shaft 15 becomes ready for being launched from archery bow 10.

Figure 5:
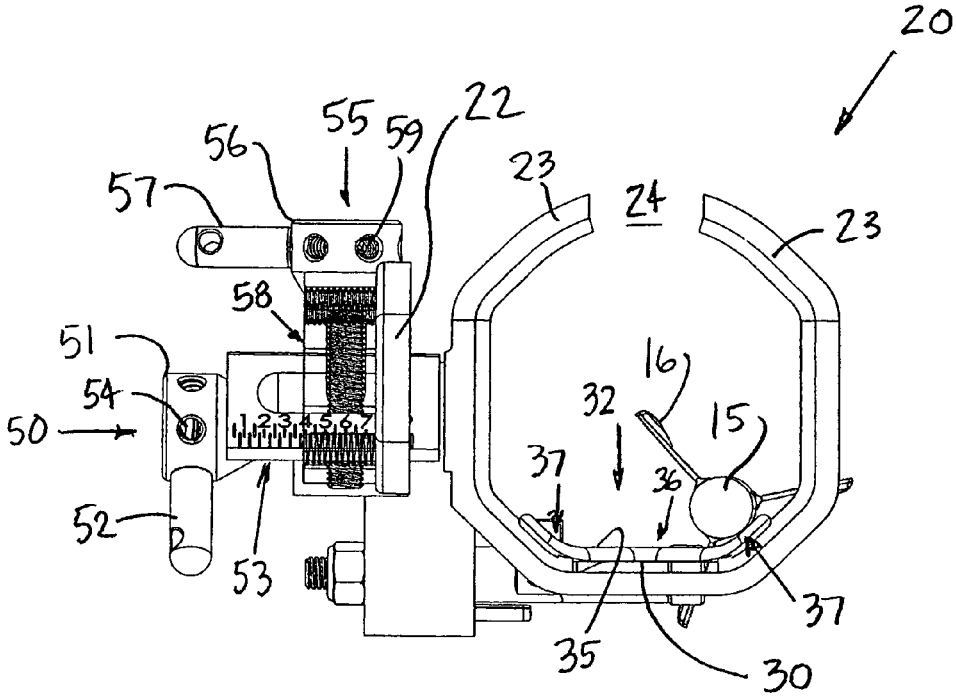
FIG. 5 is a front view of a moveable arrow rest, according to one embodiment of this invention, with the arrow shaft in a load position.
Figure 6:
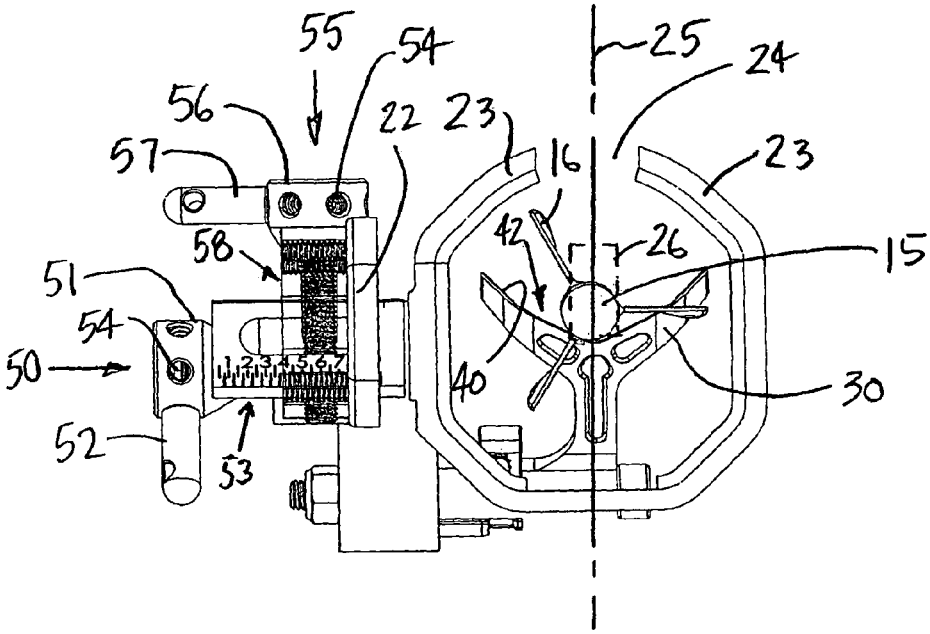
FIG. 6 is a front view of the moveable arrow rest, as shown in FIG. 5, but with the arrow shaft in a launch position.
Figure 7:
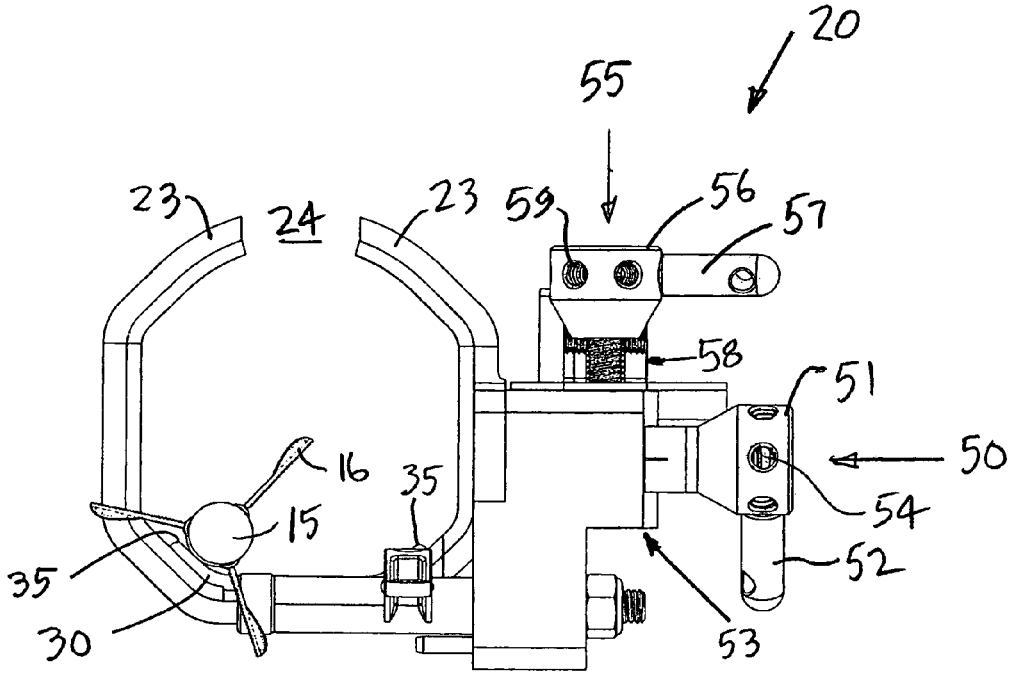
FIG. 7 is a rear view of the moveable arrow rest, as shown in FIG. 5, with the arrow shaft in a load position.
Figure 8:
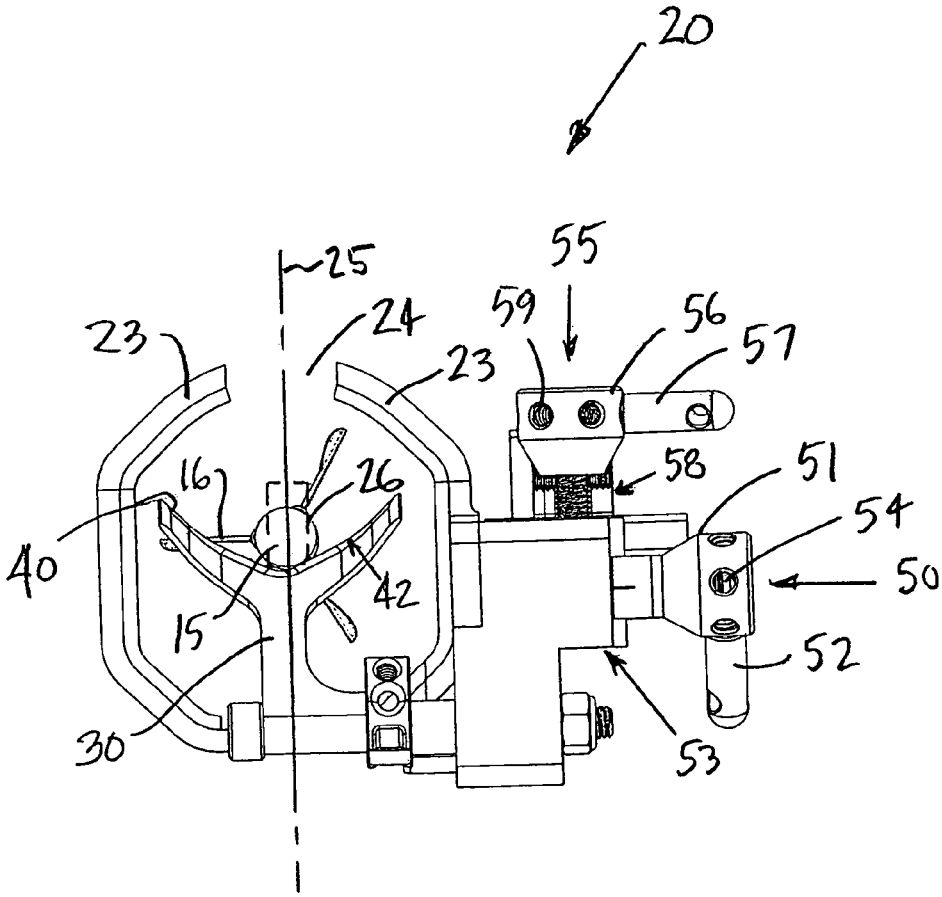
FIG. 8 is a rear view of the moveable arrow rest, as shown in FIG. 7, but with the arrow shaft in a launch position.

FIGS. 5 and 7, a front view and a rear view respectively, each shows support element 30 and thus arrow shaft 15 in the first position. FIGS. 6 and 8, a front view and a rear view respectively, each shows support element 30 and thus arrow shaft 15 in a launch position.

According to some embodiments of this invention, arrow rest 20 supports arrow shaft 15 with respect to archery bow 10. Support element 30 is mountable with respect to archery bow 10. In some embodiments of this invention, support element 30 is moveable between the first position and the second position. As shown in FIGS. 1-8, support element 30 extends from a sleeve and/or a shaft that is rotatably mounted with respect to frame 23. Support element 30 can be relatively rigid and/or can be flexible or bendable. For example, in some embodiments of this invention, support element 30 can be constructed of a shape memory material.

FIGS. 1, 3, 5 and 7 each shows support element 30 in the first position. FIGS. 2, 4, 6 and 8 each shows support element 30 in the second position. In both the first position and the second position, support surface 32 of support element 30 makes contact with an exterior surface of arrow shaft 15 and thus supports arrow shaft 15.

As shown in FIGS. 5 and 7, arrow shaft 15 is free to move with respect to support element 30. As shown in FIG. 5, support shaft 15 can move horizontally or in a direction from left to right, according to the orientation shown in FIG. 5. In some embodiments according to this invention, the relative movement of arrow shaft 15 with respect to support element 30 is possible because line of contact 35 has linear portion 36. As shown in FIG. 5, non-linear portion 37 on opposite ends of support element 30 are shaped to hold or stop the movement of arrow shaft 15 with respect to support element 30.

As shown in FIGS. 5 and 7, linear portion 36 has a particular length but in other embodiments according to this invention, linear portion 36 may be shorter or longer. As shown in FIGS. 5 and 7, non-linear portion 37 has an upward curvature from linear portion 36. In other embodiments according to this invention, non-linear portion 37 can have any other suitable shape that helps prevent arrow shaft 15 from moving beyond the ends of support element 30.

FIGS. 6 and 8 each shows support element 30, support surface 32 and thus arrow shaft 15 in the second position. As shown in FIGS. 6 and 8, when in the second position or the launch position, arrow shaft 15 is preferably positioned completely or at least partially within shooting window 26. Each of FIGS. 6 and 8 shows arrow shaft 15 not exactly centered within cradle section 45 of support element 30. In some embodiments according to this invention, it is acceptable to have arrow shaft 15 not exactly centered within support element 30, such as precisely aligned with centered location in 25, with is indicated by phantom lines in FIGS. 6 and 8. In other embodiments according to this invention, arrow shaft 15 is more precisely centered within cradle section 45 of support surface 32.

In some embodiments according to this invention, support surface 32 has line of contact 40 such as shown in FIGS. 6 and 8. Line of contact 40 comprises non-linear portion 42. As shown in FIGS. 6 and 8, non-linear portion 42 has an overall parabolic shape, with cradle section 45 centrally located within line of contact 40. In other embodiments according to this invention, non-linear portion 42 can have any other suitable shape. In other embodiments according to this invention, line of contact 40 may comprise one or more linear portions.

In some embodiments according to this invention, arrow shaft 15 preferably finds or settles into centered location 25, either precisely or within a specified margin of error. In some embodiments according to this invention, arrow shaft 15 is moved into a shooting position, such as shown in FIGS. 6 and 8 in a manner such that a forced discharging arrow shaft 15 can be applied as close as possible to a longitudinal axis of arrow shaft 15 as possible. Applying a shooting force along the longitudinal axis of arrow shaft 15 can result in a straight archery arrow flight path.

As shown in FIGS. 1-8, in some embodiments according to this invention, arrow rest 20 comprises adjustable lock 50 and adjustable lock 55. Adjustable lock 50 can be used to move arrow shaft 15 and/or the shooting position in a first direction, such as a linear direction. Likewise, adjustable lock 55 can be used to move arrow shaft 15 and/or the shooting position in a second direction, such as a linear direction which is different than the first direction.

As shown in FIGS. 1-8, arrow rest 20 comprises two adjustable locks 50 and 55, which moves arrow shaft 15 and/or the shooting position in the first direction and the second direction that are generally perpendicular with respect to each other. In other embodiments according to this invention, arrow rest 20 may comprise one or more adjustable locks.

In some embodiments according to this invention, adjustable lock 50 or 55 comprises adjustor 51 or 56 rotatably mounted with respect to linear displacement element 53 or 58. For example, the adjustor and linear displacement element arrangement can be similar to a rack and pinion gear arrangement and/or a worm gear arrangement. Any other suitable mechanical device that translates rotational movement into linear movement can be used in addition to or in lieu of adjustor 51 or 56 and linear displacement element 53 or 58.

In some embodiments according to this invention, rotation of adjustor 51 or 56 linearly moves the corresponding linear displacement element 53 or 58, in either the first linear direction or the second linear direction.

Adjustor 51 or 56 can be rotated about an axis of rotation of adjustor 51 or 56. As shown in FIGS. 5-8, according to some embodiments of this invention, adjustor 51 or 56 is formed as a rotatable element, such as a rod or a shaft. A knob or other head structure can be used to provide sufficient force through use of a distance or a lever arm that can be used to torque adjustor 51 about its axis of rotation.

In some embodiments according to this invention, such as shown in FIGS. 5-8, lever 52 or 57 can be engaged with respect to adjustor 51 or 56 to help rotate adjustor 51 or 56 about its corresponding axis of rotation.

FIGS. 5-8 show lever 52 or 57 having an externally threaded portion that is interchangeably engageable within corresponding threaded bores 54 and 59 which are positioned about a periphery of adjustor 51 or 56. In other embodiments according to this invention, any other suitable lever, structure or other mechanical device can be used to help rotate adjustor 51 or 56 about its axis of rotation. Any other suitable connection between lever 52 or 57 and adjustor 51 or 56 can be used in addition to or in lieu of the arrangement shown in FIGS. 5-8. In some embodiments, the threads of lever 52 or 57 can have a Nylok type material or insert to lock the threads together.

While in the foregoing specification this invention has been described in relation to certain preferred embodiments, and many details are set forth for purpose of illustration, it will be apparent to those skilled in the art that this invention is susceptible to additional embodiments and that certain of the details described in this specification and in the claims can be varied considerably without departing from the basic principles of this invention.

What is claimed is:

1. An arrow rest for supporting an arrow shaft with respect to an archery bow, the arrow rest comprising: a support element mountable with respect to the archery bow, a support surface of the support element movable between a first position and a second position, in the first position the support surface allowing the arrow shaft to move with respect to the archery bow, and in the second position the support surface holding the arrow shaft in a shooting position, wherein the support surface is non-planar.

2. In the arrow rest according to claim 1, wherein in the first position the support surface is shaped to allow the arrow shaft to move away from a centered location of the shooting position.

3. In the arrow rest according to claim 1, wherein in the second position the support surface is shaped to move the arrow shaft into a centered location of the shooting position.

4. In the arrow rest according to claim 3, wherein in the second position the arrow shaft contacts the support surface along a second line of contact that has a non-linear portion.

5. In the arrow rest according to claim 3, wherein in the second position the arrow shaft contacts the support surface along a second line of contact that forms a cradle section.

6. In the arrow rest according to claim 1, wherein in the second position the arrow shaft is in a launch position.

7. In the arrow rest according to claim 1, further comprising a first adjustable lock for moving the shooting position in a first linear direction, and a second adjustable lock for moving the shooting position in a second linear direction that is different than the first linear direction.

8. In the arrow rest according to claim 7, wherein the first adjustable lock and the second adjustable lock each comprises an adjustor rotatably mounted with respect to a linear displacement element.

9. In the arrow rest according to claim 8, wherein rotation of the adjustor linearly moves the corresponding linear displacement element in the first linear direction or the second linear direction.

10. An arrow rest for supporting an arrow shaft with respect to an archery bow, the arrow rest comprising: a support element mountable with respect to the archery bow, a support surface of the support element movable between a first position and a second position, in the first position the support surface allowing the arrow shaft to move with respect to the archery bow, and in the second position the support surface holding the arrow shaft in a shooting position, wherein in the first position the support surface is shaped to allow the arrow shaft to move away from a centered location of the shooting position, and in the first position the arrow shaft contacts the support surface along a first line of contact that has a linear portion and a non-linear portion.

11. In the arrow rest according to claim 10, wherein the support surface is non-planar.

12. An arrow rest for supporting an arrow shaft with respect to an archery bow, the arrow rest comprising:

a support element mountable with respect to the archery bow, a support surface of the support element movable between a first position and a second position, in the first position the support surface allowing the arrow shaft to move with respect to the archery bow, and in the second position the support surface holding the arrow shaft in a shooting position;

a first adjustable lock for moving the shooting position in a first linear direction, and a second adjustable lock for moving the shooting position in a second linear direction that is different than the first linear direction, the first adjustable lock and the second adjustable lock each comprises an adjustor rotatably mounted with respect to a linear displacement element, wherein a lever is removably attached to the adjustor to form a lever arm about an axis of rotation of the adjustor.

13. In the arrow rest according to claim 12, wherein the lever has a threaded portion that is interchangeably engageable within each of a plurality of internally threaded bores positioned about a periphery of the adjustor.

14. An arrow rest for supporting an arrow shaft with respect to an archery bow, the arrow rest comprising: a support element mountable with respect to the archery bow, a support surface of the support element movable between a first position and a second position, in the first position the support surface allowing the arrow shaft to move away from a shooting position, in the second position the support surface laterally aligning the arrow shaft in the shooting position, a first adjustable lock for moving the shooting position in a first linear direction, and a second adjustable lock for moving the shooting position in a second linear direction that is different than the first linear direction, wherein in the first position the arrow shaft contacts the support surface along a first line of contact that has a linear portion and a non-linear portion.

15. In the arrow rest according to claim 14, wherein the first adjustable lock and the second adjustable lock each comprises an adjustor rotatably lockable with respect to a linear displacement element.

16. In the arrow rest according to claim 14, wherein in the first position the support surface is shaped to allow the arrow shaft to move away from a centered location of the shooting position.

17. In the arrow rest according to claim 14, wherein in the second position the support surface is shaped to move the arrow shaft into a centered location of the shooting position.

18. In the arrow rest according to claim 14, wherein in the second position the arrow shaft contacts the support surface along a second line of contact that has a non-linear portion.

19. In the arrow rest according to claim 14, wherein in the second position the arrow shaft contacts the support surface along a second line of contact that forms a cradle section.

20. An arrow rest for supporting an arrow shaft with respect to an archery bow, the arrow rest comprising:

a support element mountable with respect to the archery bow, a support surface of the support element movable between a first position and a second position, in the first position the support surface allowing the arrow shaft to move away from a shooting position, in the second position the support surface laterally aligning the arrow shaft in the shooting position, a first adjustable lock for moving the shooting position in a first linear direction, and a second adjustable lock for moving the shooting position in a second linear direction that is different than the first linear direction, the first adjustable lock and the second adjustable lock each comprising an adjustor rotatably lockable with respect to a linear displacement element, wherein a lever is removably attached to the adjustor to form a lever arm about an axis of rotation of the adjustor.

21. In the arrow rest according to claim 20, wherein the lever has a threaded portion that is interchangeably engageable within each of a plurality of internally threaded bores positioned about a periphery of the adjustor.

22. In the arrow rest according to claim 20, wherein in the first position the arrow shaft contacts the support surface along a first line of contact that has a linear portion and a non-linear portion.

* * * * *